US010655905B2

(12) United States Patent
Candido et al.

(10) Patent No.: US 10,655,905 B2
(45) Date of Patent: May 19, 2020

(54) FLEXIBLE COMPARTMENT FOR A REFRIGERATOR

(71) Applicant: WHIRLPOOL CORPORATION, Benton Harbor, MI (US)

(72) Inventors: Claudinei Freitas Candido, Santa Catarina (BR); Bruno Ribeiro, Santa Catarina (BR); Jonathan Watzko, Santa Catarina (BR)

(73) Assignee: Whirlpool Corporation, Benton Harbor, MI (US)

( * ) Notice: Subject to any disclaimer, the term of this patent is extended or adjusted under 35 U.S.C. 154(b) by 221 days.

(21) Appl. No.: 15/621,683

(22) Filed: Jun. 13, 2017

(65) Prior Publication Data

US 2018/0356145 A1 Dec. 13, 2018

(51) Int. Cl.

| | |
|---|---|
| ***F25D 23/02*** | (2006.01) |
| ***F25D 11/02*** | (2006.01) |
| ***F25D 23/06*** | (2006.01) |
| ***F25D 25/02*** | (2006.01) |

(52) U.S. Cl.

CPC ..... *F25D 23/025* (2013.01); *F25D 11/02* (2013.01); *F25D 23/069* (2013.01); *F25D 25/02* (2013.01); *F25D 2400/16* (2013.01)

(58) Field of Classification Search

CPC ..... F25D 23/02; F25D 23/06; F25D 23/069; F25D 23/025; F25D 2323/061; F25D 2323/062; F25D 2325/021; F25D 2500/02; F25D 2400/16

See application file for complete search history.

(56) References Cited

U.S. PATENT DOCUMENTS

| | | | |
|---|---|---|---|
| 774,117 | A | 11/1904 | Tandy |
| 2,282,342 | A | 5/1942 | Preble |
| 2,412,904 | A | 12/1946 | Money et al. |
| 2,434,117 | A | 1/1948 | Money et al. |
| 2,466,360 | A | 4/1949 | Bitney |

(Continued)

FOREIGN PATENT DOCUMENTS

| | | | |
|---|---|---|---|
| BR | PI0100491 | B1 | 6/2009 |
| BR | PI0805999 | A2 | 6/2010 |

(Continued)

OTHER PUBLICATIONS

GE Appliances, Refrigerator Capacity & Organization: Making Room for More, Jan. 17, 2014, http://www.geappliances.com/appliances/refrigerators/refrigerator-capacity-organize.htm.

(Continued)

*Primary Examiner* — Jianying C Atkisson
*Assistant Examiner* — Meraj A Shaikh
(74) *Attorney, Agent, or Firm* — Price Heneveld LLP

(57) ABSTRACT

A freezer compartment having a flexible size is provided. In a refrigerator, a storage compartment includes an insulated shelf to separate a freezer compartment from a refrigerator compartment. The insulated shelf is movable to alter the size of the freezer compartment. In some cases, the freezer compartment is accessed by an internal door having a main door and a secondary door that can open separately to provide selective access to portions of the storage compartment. In other cases, the freezer compartment is accessed by an internal door that swings up about a horizontally-directed hinge axis.

17 Claims, 10 Drawing Sheets

(56) References Cited

U.S. PATENT DOCUMENTS 2,509,592 A 5/1950 Giffard
2,517,385 A 8/1950 Clark
2,573,272 A 10/1951 Petkwitz
2,597,267 A 5/1952 Shoemaker et al.
2,694,906 A 11/1954 Didion
2,710,993 A 6/1955 Kirkpatrick
2,737,782 A 3/1956 Antico
2,742,559 A 4/1956 Edelman
2,748,573 A 6/1956 Staebler et al.
2,773,677 A 12/1956 Hinkel
2,804,068 A 8/1957 Miller et al.
2,841,132 A 7/1958 Philipp
2,875,016 A 2/1959 Fry
3,410,260 A 11/1968 Morgan
3,866,437 A 2/1975 Spencer
4,304,101 A * 12/1981 Gidseg ..... F25D 17/065 62/187
4,638,644 A 1/1987 Gidseg
4,732,435 A 3/1988 Bailey et al.
4,834,557 A 5/1989 Dreinhoff
4,914,928 A 4/1990 Fellwock et al.
4,998,382 A 3/1991 Kostos et al.
5,362,145 A 11/1994 Bird et al.
5,415,472 A 5/1995 Brise
5,429,043 A 7/1995 Becker
5,447,146 A 9/1995 Nickerson
5,524,981 A 6/1996 Herrmann et al.
5,564,809 A 10/1996 Kane et al.
5,660,777 A 8/1997 Herrmann et al.
5,735,589 A 4/1998 Herrmann et al.
5,813,741 A 9/1998 Fish et al.
5,918,959 A 7/1999 Lee
6,045,101 A 4/2000 Goyette et al.
6,174,482 B1 1/2001 Reames et al.
6,220,684 B1 4/2001 Bent et al.
6,474,094 B2 11/2002 Kim
6,488,347 B1 12/2002 Bienick
6,604,800 B2 8/2003 Hamilton
6,811,045 B1 11/2004 Masker et al.
D505,140 S 5/2005 Reed et al.
D516,100 S 2/2006 Vardon
D516,102 S 2/2006 Vardon
D523,034 S 6/2006 Vardon
7,059,693 B2 6/2006 Park
D525,633 S 7/2006 Vardon
7,070,249 B2 7/2006 Leimkuehler et al.
7,131,545 B1 11/2006 Grogan
7,178,890 B2 2/2007 Park et al.
7,188,738 B2 3/2007 Stafford et al.
7,232,194 B2 6/2007 Becke et al.
D551,262 S 9/2007 Becke
7,270,385 B2 9/2007 Mathur et al.
7,552,983 B2 6/2009 Shin
7,651,182 B2 1/2010 Eveland et al.
7,726,753 B2 6/2010 Bassi
7,748,569 B2 7/2010 Sunatori
7,748,806 B2 7/2010 Egan
7,878,344 B2 2/2011 Martin et al.
7,976,113 B2 7/2011 Gwak
D656,970 S 4/2012 Merritt
8,172,347 B2 5/2012 Lim et al.
8,240,512 B2 8/2012 Sunatori
D669,506 S 10/2012 Czach et al.
8,297,726 B2 10/2012 Ramm et al.
8,336,976 B2 12/2012 Lee
8,348,362 B2 1/2013 Candeo et al.
8,359,881 B2 1/2013 Junge et al.
8,381,949 B2 2/2013 Sunatori
8,403,438 B2 3/2013 Park et al.
8,414,095 B2 4/2013 Stewart
D692,034 S 10/2013 Seo et al.
8,562,089 B2 10/2013 Collins et al.
D694,288 S 11/2013 Hottmann et al.
D694,289 S 11/2013 Hottmann et al.
D694,292 S 11/2013 Eby et al.
8,616,665 B2 12/2013 Czach et al.
8,640,482 B2 2/2014 Lim et al.
8,726,689 B2 5/2014 Jang et al.
8,733,862 B1 5/2014 Armstrong et al.
D707,267 S 6/2014 Choi et al.
8,739,568 B2 6/2014 Allard et al.
D709,927 S 7/2014 Park et al.
8,777,341 B2 7/2014 Amaral et al.
D710,405 S 8/2014 Seo et al.
D710,406 S 8/2014 Seo et al.
D711,943 S 8/2014 Park et al.
8,833,882 B2 9/2014 Seo et al.
D714,840 S 10/2014 Yang et al.
D717,349 S 11/2014 Seo et al.
D719,986 S 12/2014 Kim et al.
8,960,826 B2 2/2015 Choo et al.
9,033,437 B2 5/2015 Klitzing et al.
D734,784 S 7/2015 Kim et al.
9,097,457 B2 8/2015 Kim
9,127,878 B2 9/2015 Gossens et al.
9,151,534 B2 10/2015 Lee et al.
D745,581 S 12/2015 Jeon et al.
9,217,601 B2 12/2015 Koo et al.
D747,369 S 1/2016 McConnell et al.
D747,370 S 1/2016 Kim et al.
D747,371 S 1/2016 Lee et al.
D747,372 S 1/2016 Kim et al.
D747,373 S 1/2016 Lee et al.
D748,165 S 1/2016 McConnell et al.
9,234,690 B2 1/2016 McCollugh et al.
9,250,010 B2 2/2016 De La Garza et al.
9,297,573 B2 3/2016 Krause et al.
D754,759 S 4/2016 McConnell et al.
9,320,368 B2 4/2016 Marotti et al.
9,328,955 B2 5/2016 Castro Solis et al.
9,339,993 B2 5/2016 Cites et al.
D761,884 S 7/2016 Austin et al.
9,488,405 B2 11/2016 Lee et al.
9,500,403 B2 11/2016 Seo et al.
9,510,679 B2 12/2016 Bhatt et al.
9,671,115 B2 6/2017 Elkasevic
2003/0020387 A1 1/2003 Wing et al.
2004/0012314 A1 1/2004 Hay et al.
2004/0104323 A1 6/2004 Hubert et al.
2005/0073225 A1 4/2005 Kwon et al.
2006/0145577 A1 7/2006 Daley et al.
2006/0226751 A1 10/2006 Park
2007/0126325 A1 6/2007 Gorz et al.
2008/0203041 A1 8/2008 Lim et al.
2010/0024464 A1 2/2010 Hwang et al.
2010/0102693 A1 4/2010 Driver et al.
2010/0109498 A1 5/2010 Ramm et al.
2011/0001415 A1 1/2011 Park et al.
2011/0072846 A1 3/2011 Engel et al.
2011/0115356 A1 5/2011 Nash et al.
2012/0018434 A1 1/2012 Gwak
2012/0091084 A1 4/2012 Amaral et al.
2012/0223038 A1 9/2012 Bean
2012/0248958 A1 10/2012 Ertz et al.
2013/0020922 A1 1/2013 Jang
2013/0049562 A1* 2/2013 Jung ..... F25D 23/028 312/405
2014/0216095 A1 8/2014 LeClear et al.
2015/0034668 A1 2/2015 Minard et al.
2015/0061484 A1 3/2015 Jeong et al.
2015/0107084 A1 4/2015 Craycraft et al.
2015/0168048 A1 6/2015 Sexton et al.
2015/0184929 A1 7/2015 Moon
2016/0061511 A1* 3/2016 Park ..... F25D 11/02 312/404
2016/0161174 A1* 6/2016 Yi ..... F25D 23/067 62/285
2016/0290707 A1 10/2016 Burke et al.

(56) References Cited

U.S. PATENT DOCUMENTS

| | | | |
|---|---|---|---|
| 2017/0086580 | A1 | 3/2017 | Conti |
| 2017/0181538 | A1 | 6/2017 | Azkue et al. |

FOREIGN PATENT DOCUMENTS

| | | | |
|---|---|---|---|
| CN | 101611281 | A | 12/2009 |
| CN | 201779952 | U | 3/2011 |
| CN | 102135363 | A | 7/2011 |
| CN | 102395849 | A | 3/2012 |
| CN | 102494496 | A | 6/2012 |
| CN | 202432813 | U | 9/2012 |
| CN | 102829604 | A | 12/2012 |
| CN | 102889744 | A | 1/2013 |
| DE | 8801508 | U1 | 6/1989 |
| DE | 10107646 | A1 | 8/2002 |
| DE | 102009045363 | A1 | 4/2011 |
| DE | 102011003037 | A1 | 7/2012 |
| DE | 102013216974 | A1 | 4/2014 |
| DE | 102012223131 | A1 | 6/2014 |
| EP | 0577939 | A1 | 1/1994 |
| EP | 1152201 | A1 | 7/2001 |
| EP | 1790250 | A2 | 5/2007 |
| EP | 1349802 | B1 | 8/2008 |
| EP | 2072937 | A2 | 6/2009 |
| EP | 2098810 | A2 | 9/2009 |
| EP | 2424421 | B1 | 10/2015 |
| EP | 2760315 | B1 | 8/2016 |
| JP | S52126461 | U | 9/1977 |
| JP | H110115485 | A | 5/1998 |
| JP | H110122733 | A | 5/1998 |
| JP | H111237173 | A | 8/1999 |
| JP | 2002090054 | A | 3/2002 |
| KR | 100431346 | B1 | 5/2004 |
| KR | 20040095421 | A | 11/2004 |
| KR | 100756887 | B1 | 9/2007 |
| KR | 20100023474 | A | 3/2010 |
| KR | 20140022598 | A | 2/2014 |
| WO | 02014761 | A1 | 2/2002 |
| WO | 2004104504 | A1 | 12/2004 |
| WO | 2005012812 | A1 | 2/2005 |
| WO | 2005100887 | A1 | 10/2005 |
| WO | 2007128734 | A1 | 11/2007 |
| WO | 2008015180 | A2 | 2/2008 |
| WO | 2009155679 | A2 | 12/2009 |
| WO | 2011009773 | A2 | 1/2011 |
| WO | 2011080109 | A2 | 7/2011 |
| WO | 2012025382 | A2 | 3/2012 |
| WO | 2012062670 | A2 | 5/2012 |
| WO | 2013126515 | A1 | 8/2013 |
| WO | 2015101430 | A1 | 7/2015 |
| WO | 2015101434 | A1 | 7/2015 |
| WO | 2015149832 | A1 | 10/2015 |
| WO | 2015165531 | A1 | 11/2015 |
| WO | 2016155784 | A1 | 10/2016 |
| WO | 2017005314 | A1 | 1/2017 |

OTHER PUBLICATIONS

GE Appliances, GE Profile Side by Side Refrigerators, Jan. 17, 2014, http://www.abt.com/ge/GE_Profile_SideBySide.

* cited by examiner

FLEXIBLE COMPARTMENT FOR A REFRIGERATOR

TECHNICAL FIELD

The present disclosure generally relates to a refrigerator having a flexibly-sized compartment with an internal access door.

BACKGROUND

A conventional refrigerator typically includes one or more cold storage compartments, including both a freezer portion or compartment and a fresh food or refrigerator portion or compartment. The compartments may be arranged side-by-side or top-to-bottom, and be separated by an insulated shelf, or mullion wall. The refrigerator may also include one or more shelves and drawers for separating the compartments and providing area and surfaces for storing food. In addition, a conventional refrigerator typically includes one or more doors for accessing the storage compartments and for sealing the compartments to prevent cold air leakage.

SUMMARY

According to one aspect of the disclosure, a door assembly for a refrigerator is described and includes a main door for accessing a first cold compartment and a secondary door for accessing a second cold compartment. The main door is configured to pivot about a main hinge axis between a closed position and an open position with respect to the first cold compartment. The secondary door is coupled to the main door and is configured to pivot about a secondary hinge axis between a closed position and an open position with respect to the second cold compartment. Further, the opening of the main door with respect to the first cold compartment opens the secondary door with respect to the second cold compartment.

In another aspect of the disclosure, a refrigerator is described and includes a cabinet defining a cold storage compartment, wherein a first portion of the cold storage compartment includes a freezer compartment and a second portion of the cold storage compartment includes a refrigerator compartment. A door is movably coupled to the cabinet for accessing the cold storage compartment, and the door is configured to pivot between a closed position and an open position with respect to the cold storage compartment. The refrigerator also includes a cooling component for cooling the cold storage compartment, whereby the cooling component is in fluid communication with both the freezer compartment and the refrigerator compartment. Further, the refrigerator includes an internal door for accessing the freezer compartment, wherein the internal door has a main portion and a secondary portion. According to at least one aspect, the freezer compartment is separated from the refrigerator compartment by an insulated shelf that is movable between a first position and a second position to change the size of the freezer compartment. In addition, the main portion and the secondary portion of the internal door provide access to the freezer compartment when the insulated shelf is in the first position, and the main portion of the internal door provides access to the freezer compartment when the insulated shelf is in the second position.

In yet another aspect of the disclosure, a refrigerator is described and includes a cabinet defining a cold storage compartment, wherein a first portion of the cold storage compartment includes a freezer compartment and a second portion of the cold storage compartment includes a refrigerator compartment. The refrigerator further includes a door movably coupled to the cabinet for accessing the cold storage compartment, wherein the door is configured to pivot about a first hinge axis between a closed position and an open position with respect to the cold storage compartment. The refrigerator also includes a cooling component for cooling the cold storage compartment, whereby the cooling component is in fluid communication with both the freezer compartment and the refrigerator compartment. In addition, the refrigerator includes an internal door for accessing the freezer compartment, wherein the internal door is configured to pivot about a second hinge axis that is perpendicular to the first hinge axis. Still further, the refrigerator includes an insulated shelf that separates the freezer compartment from the refrigerator compartment, wherein the insulated shelf is movable between a first position and a second position to change the size of the freezer compartment.

These and other features, advantages, and objects of the present invention will be further understood and appreciated by those skilled in the art by reference to the following specification, claims, and appended drawings.

BRIEF DESCRIPTION OF THE DRAWINGS

The foregoing summary, as well as the following detailed description, will be better understood when read in conjunction with the appended drawings. For the purpose of illustrating aspects described herein, there are shown in the drawings, certain embodiment(s) which are presently preferred. It should be understood, however, that the present disclosure is not limited to the precise arrangements and instrumentalities shown. Drawings are not necessary to scale. Certain features may be exaggerated in scale or shown in schematic form in the interest of clarity and conciseness.

DETAILED DESCRIPTION

The present disclosure provides a refrigerator having a flexibly-sized internal cold storage compartment. In some cases, the flexibly-sized compartment is a freezer compartment having an internal access door. More specifically, as described herein, the refrigerator may include an insulated shelf, or removable mullion, that may serve as a temperature barrier within the internal storage compartment, to separate the freezer compartment from a refrigerator compartment, and to maintain the different temperature regions within the refrigerator. In some cases, the insulated shelf may be movable between multiple positions to expand or reduce the size of the freezer compartment and refrigerator compartment. The refrigerator may also include an internal access door that is configured for accessing the freezer compartment, or, based on the location of the insulated shelf, for accessing portions of the refrigerator compartment.

Figure 2:
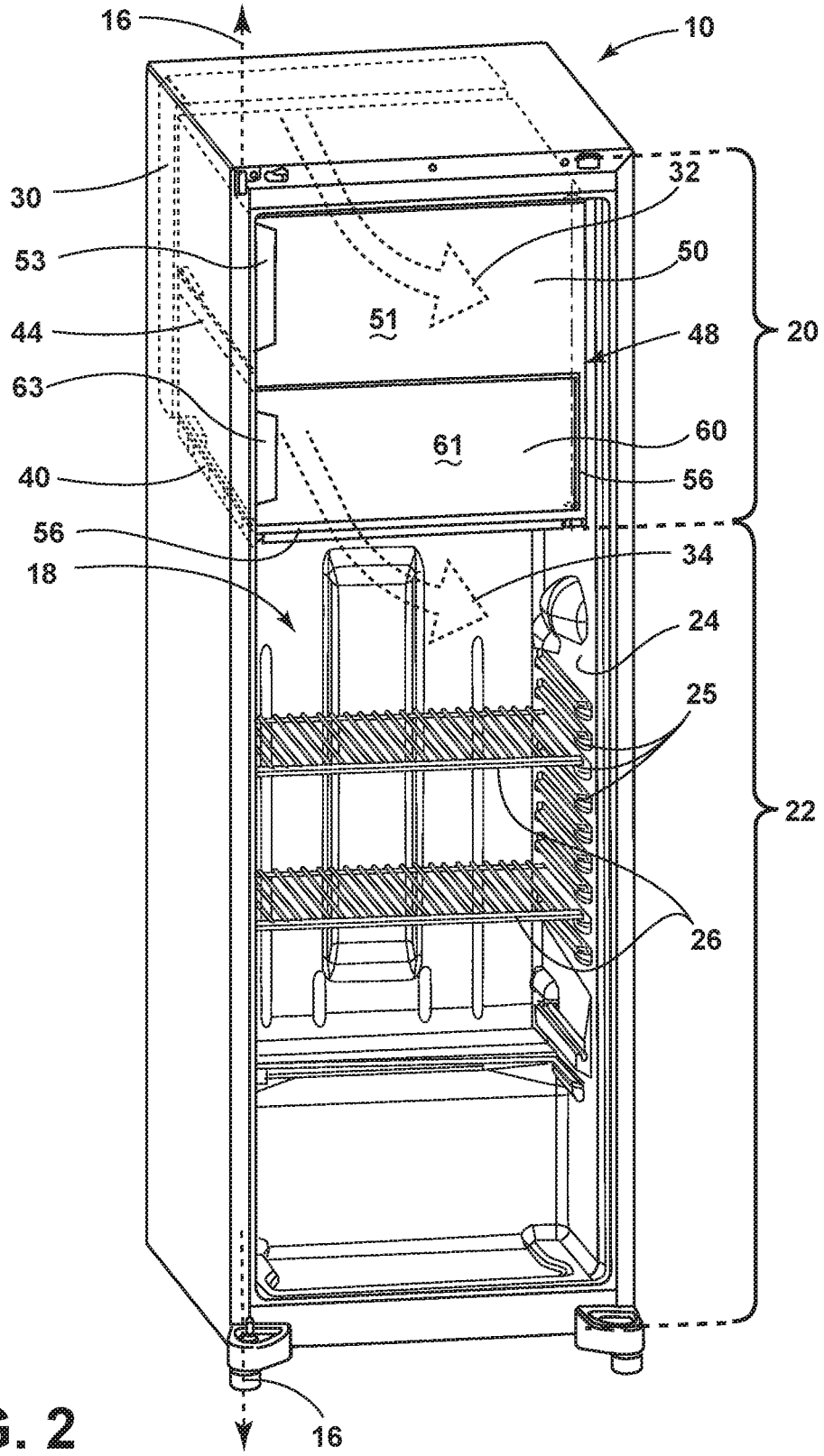
FIG. 2 is a top perspective view of the refrigerator with a front door removed, according to an embodiment described herein.
Figure 3A:
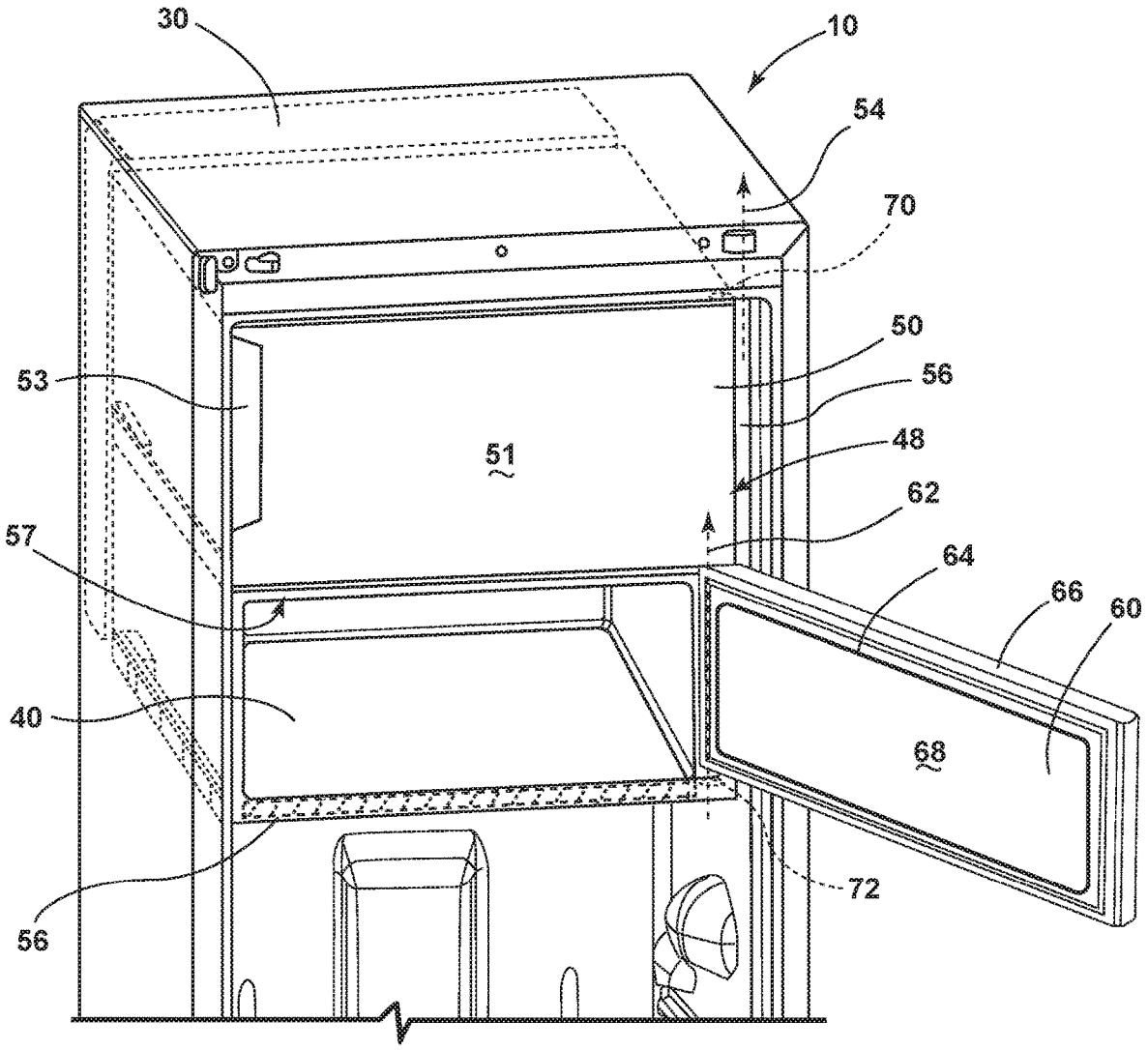
FIGS. 3A and 3B are partial top perspective views of the refrigerator with the front door removed, according to an embodiment described herein.
Figure 3B:
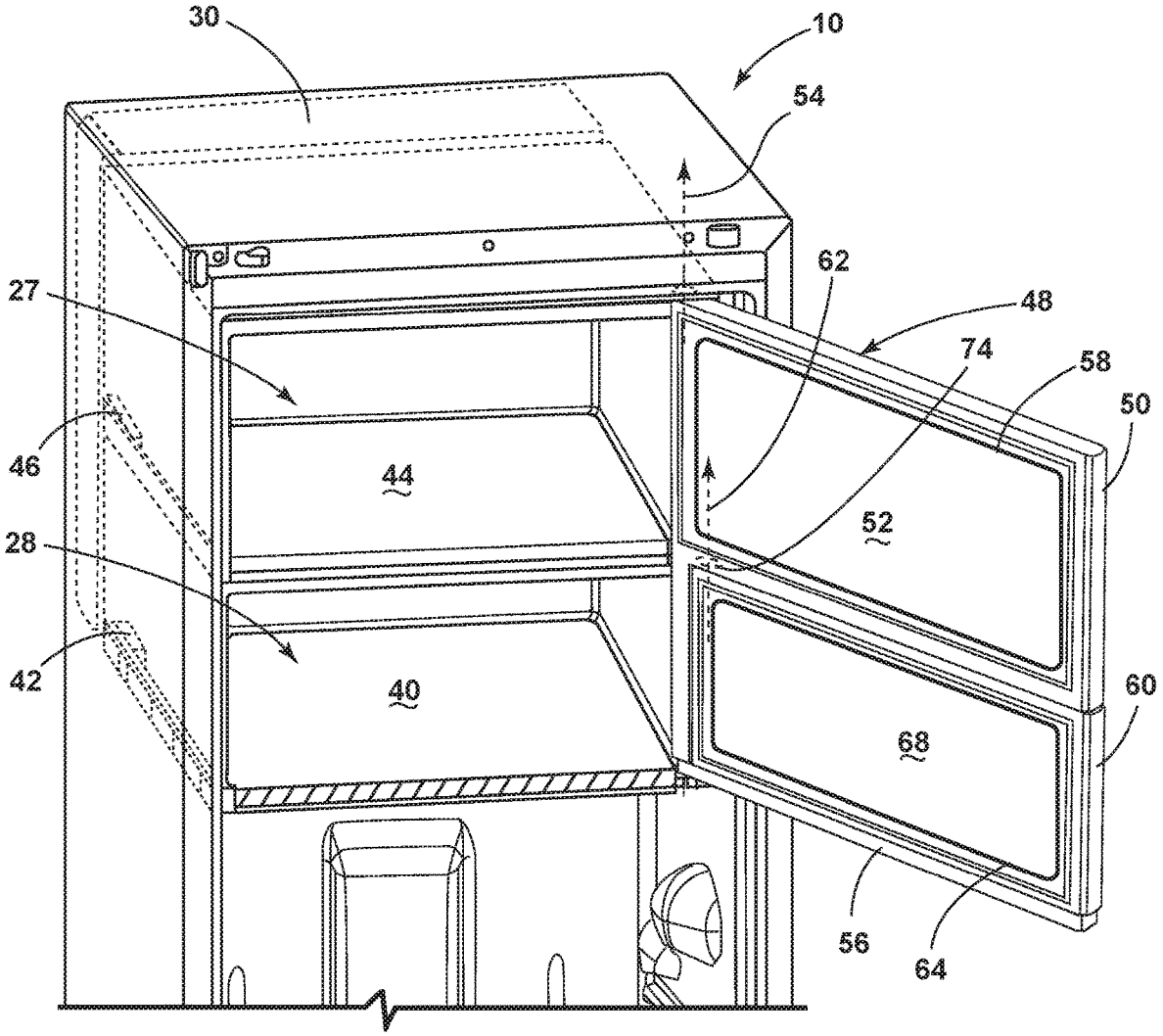

In an illustrated embodiment, referring to FIGS. 2 and 3A-3B, a refrigerator 10 may include an internal cold storage compartment 18 separated into a first compartment portion 20, and a second compartment portion 22. In at least one case, first compartment portion 20 comprises a freezer compartment and second compartment portion 22 comprises a refrigerator compartment. The first compartment portion 20 is separated from the second compartment portion 22 by a movable mullion, or insulated shelf 40, that provides a temperature barrier between freezing air 32 and cold (not freezing) air 34. A divider shelf 44 may be located within the first compartment portion 20 to provide additional storage space. Further, the insulated shelf 40 and the divider shelf 44 are interchangeable, effectively enlarging or reducing the size of the first compartment portion 20. In the embodiment, an internal door 48 includes a main portion 50 and a secondary portion 60 to provide selective access to the first compartment portion 20.

The present illustrated embodiments reside primarily in combinations of components related to a refrigerator having a flexibly-sized freezer compartment and internal access door. Accordingly, the apparatus components have been represented, where appropriate, by conventional symbols in the drawings, showing only those specific details that are pertinent to understanding the embodiments of the present disclosure. Further, like numerals in the description and drawings represent like elements.

Figure 1:
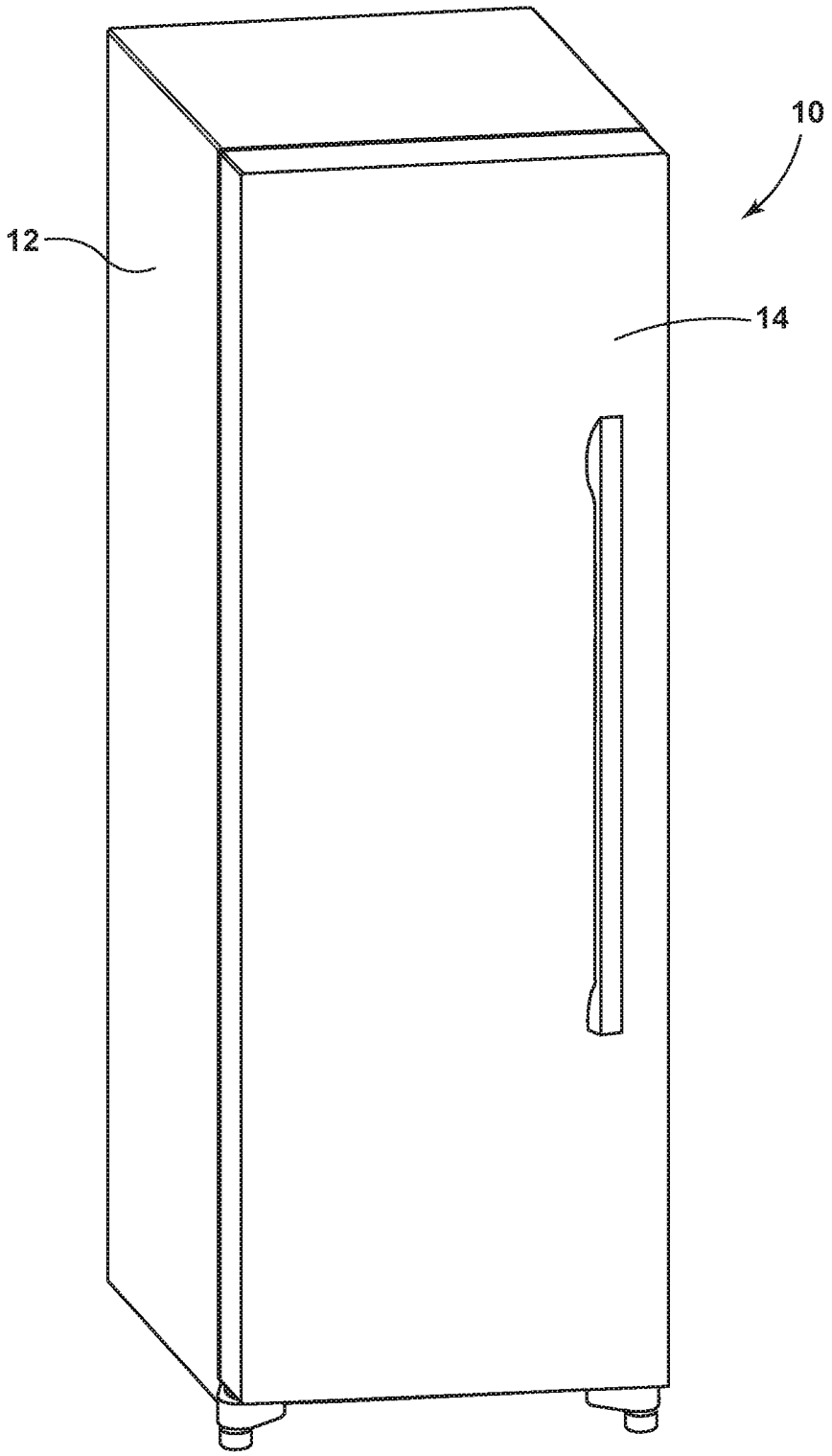
FIG. 1 is a top perspective view of a refrigerator, according to an embodiment described herein.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Before the subject invention is described further, it is to be understood that the invention is not limited to the particular embodiments of the invention described below, as variations of the particular embodiments may be made and still fall within the scope of the appended claims. It is also to be understood that the terminology employed is for the purpose of describing particular embodiments, and is not intended to be limiting. Instead, the scope of the present invention will be established by the appended claims.

Where a range of values is provided, it is understood that each intervening value, to the tenth of the unit of the lower limit unless the context clearly dictates otherwise, between the upper and lower limit of that range, and any other stated or intervening value in that stated range, is encompassed within the invention. The upper and lower limits of these smaller ranges may independently be included in the smaller ranges, and are also encompassed within the invention, subject to any specifically excluded limit in the stated range. Where the stated range includes one or both of the limits, ranges excluding either or both of those included limits are also included in the invention.

In this specification and the appended claims, the singular forms "a," "an," and "the" include plural reference unless the context clearly dictates otherwise.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

FIGS. 1 and 2 depict a top perspective view of an exemplary refrigerator 10, and refrigerator 10 with a front door 14 removed, respectively. As shown in the illustrated embodiment in FIGS. 1 and 2, refrigerator 10 may be outwardly embodied as a conventional refrigerator, and include an outer cabinet 12 and a front door 14 for accessing an internal cold storage compartment 18. In the illustrated embodiment, front door 14 is movably coupled to outer cabinet 12 about a door hinge axis 16 for accessing internal cold storage compartment 18.

Referring to FIG. 2, internal cold storage compartment 18 may be divided into a first compartment portion 20, and a second compartment portion 22. First compartment portion 20 and second compartment portion 22 may be cooled to different temperatures and may be disposed at various positions relative to each other within cold storage compartment 18. For example, in some cases, as shown in the illustrated embodiment, first compartment portion 20 is a freezer compartment and is disposed at an upper portion of internal cold storage compartment 18. Further, in the illustrated embodiment, second compartment portion 22 is a refrigerator compartment, and extends from below first compartment portion 20 to a bottom of internal cold storage compartment 18.

Internal cold storage compartment 18 may be configured with a variety of internal storage and other features as would be contemplated by a skilled artisan. For example, shelves, drawers, doors, dividers, drink holders, drink dispensers and other interior features may be included in internal cold storage compartment 18. In the illustrated embodiment, second compartment portion 22 includes an interior surface 24 having a plurality of shelves 26 supported by shelf supports 25. Additionally, in at least one embodiment, first compartment portion 20 includes an insulated shelf 40 and a divider shelf 44, enclosed by internal door 48, as described in more detail below. It will be readily understood, however, that the configuration of internal cold storage compartment 18 is not limited by the disclosed embodiments, and those of skill in the art will contemplate the various configurations available for an internal storage compartment as described herein.

Referring to FIG. 2, refrigerator 10 further includes a cooling component 30 for generating cooled air to pass into internal cold storage compartment 18. Specifically, cooling component 30 may be in fluid communication with portions of internal cold storage compartment 18 via one or more air passages (not shown) to provide cooled air to internal cold storage compartment 18. The cooled air may be passed to either or both of the first compartment portion 20 and second compartment portion 22. In at least one case, freezing air 32 is in fluid communication with first compartment portion 20, and cold (not freezing) air 34 is in fluid communication with second compartment portion 22. In this embodiment, first compartment portion 20 is a freezer compartment and second compartment portion 22 is a refrigerator compartment, and the compartments are separated by an insulated barrier or mullion to provide a temperature barrier to prevent or reduce the comingling of the freezing air 32 and the cold air 34 between the separate compartments. In at least one case, an insulated shelf 40, described in more detail below, may provide a temperature barrier between first compartment portion 20 and second compartment portion 22 such that first compartment portion 20 is kept within a standard freezing temperature range and second compartment portion 22 is kept within a standard refrigerator temperature range, both ranges as would be known in the art.

Cooling component may include any type of conventional cooling component known in the art. In at least one case, cooling component 30 may include a compressor (not shown), condenser (not shown), an expansion device (not shown), and an evaporator (not shown) connected in series and charged with a refrigerant. As would be known in the art, the evaporator may be a type of heat exchanger to transfer heat passing over the evaporator to a refrigerant flowing within the evaporator, thereby removing heat within the refrigerator and providing cooled air within the refrigerator 10.

While the present disclosure is illustrated with respect to a particular refrigerator 10, the embodiments set forth herein are intended for illustrative purposes only. It should be understood that refrigerator 10 is only one type of refrigerator in which embodiments of the present disclosure may be demonstrated and, therefore those skilled in the art will appreciate that the present disclosure is not limited to any particular type of refrigerator, such as refrigerator 10.

According to some embodiments described herein, refrigerator 10 may include provisions to increase or decrease the respective sizes of first compartment portion 20 and second compartment portion 22. For example, in some cases, refrigerator 10 may include mullions, shelves, or retractable doors that may be movable to increase or decrease compartments within refrigerator 10. In at least one case refrigerator 10 may include one or more shelves that are movably coupled to internal cold storage compartment 18 such that their location within internal cold storage compartment 18 may be changed or they may be removed altogether.

Figure 4:
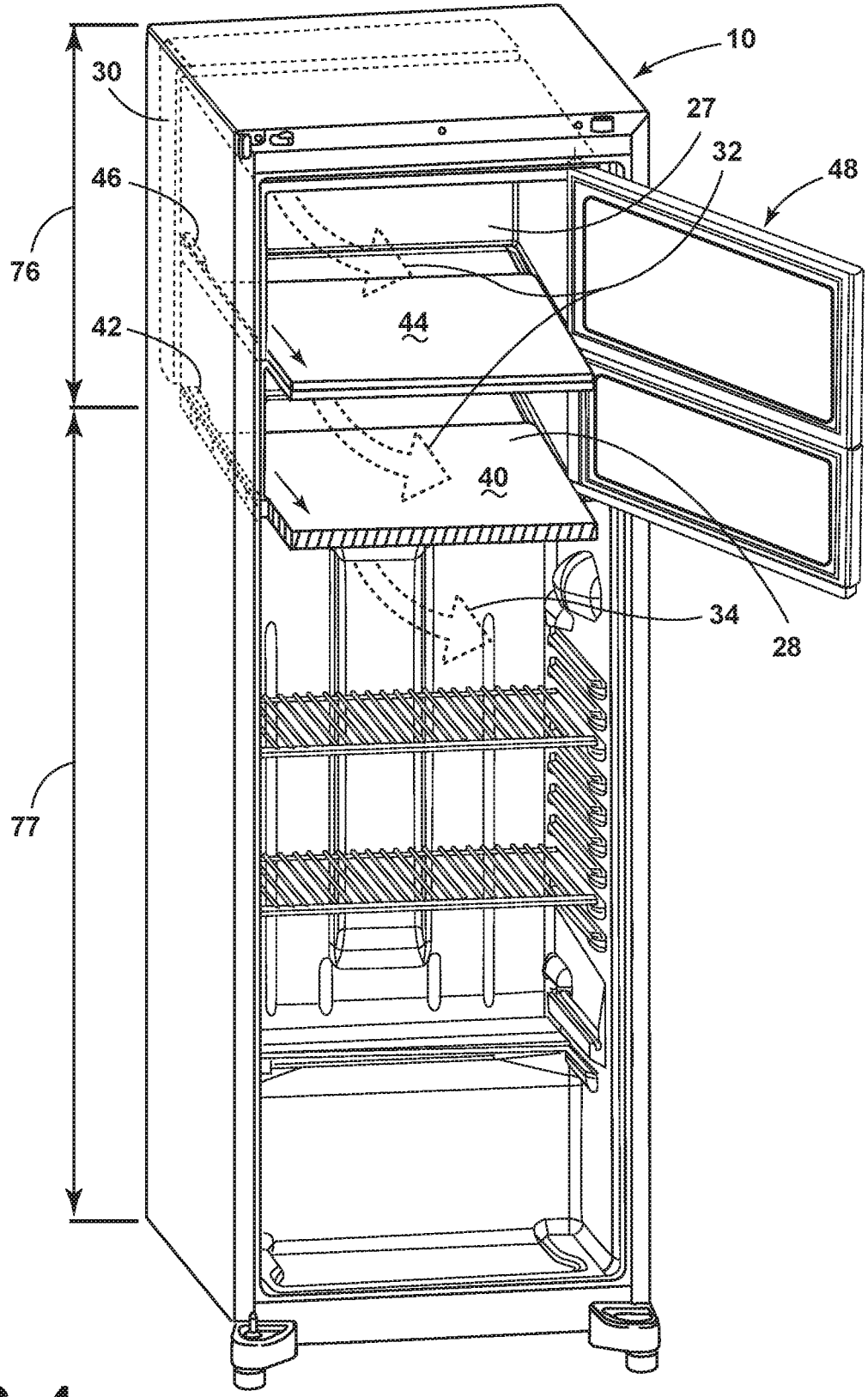
FIGS. 4 and 5 are top perspective views of the refrigerator with the front door removed, according to an embodiment described herein.

Referring to the illustrated embodiments, refrigerator 10 includes a movable mullion or insulated shelf 40 that provides a temperature barrier between first compartment portion 20 and second compartment portion 22. Refrigerator 10 may also include a divider shelf 44 for providing extra storage space. With reference to FIG. 4, insulated shelf 40 may be secured within internal cold storage compartment 18 via rack 42 and divider shelf 44 may be secured within internal cold storage compartment 18, and in particular within first compartment portion 20, via rack 46.

According to an embodiment described herein, insulated shelf 40 and divider shelf 44 may be configured as slide-in shelves that are held in place by rack 42 and rack 46, respectively. Rack 42 and rack 46 may be disposed on a surface of internal cold storage compartment 18. Accordingly, as described in more detail below, insulated shelf 40 and divider shelf 44 may be configured to be removed and placed in opposite positions. In other words, insulated shelf 40 may be removed and replaced in a top position or receiving slot with respect to divider shelf 44, i.e., held in place by rack 46. Similarly, divider shelf 44 may be removed and replaced in a bottom position or receiving slot with respect to insulated shelf 40, i.e., held in place by rack 42. However, it is contemplated that insulated shelf 40 and divider shelf 44 may be configured in other ways and still fall within the spirit and scope of the present invention. For instance, the shelves may be held in place by other types of supports, such as a support along a rear surface of internal cold storage compartment 18, or they may be movably coupled to internal cold storage compartment 18 with screws, pegs or any other means contemplated by a skilled artisan.

In accordance with aspects known in the art, insulated shelf 40 may be formed of any suitable resilient and/or thermal material such that insulated shelf 40 provides a temperature barrier to prevent freezing air 32 from migrating into cold (not freezing) air 34 and vice versa. For example, in one case, insulated shelf 40 may be formed of a molded plastic material filled with an extruded foam material or other insulating material as would be contemplated by a skilled artisan. Divider shelf 44 may also be formed of a suitable resilient material contemplated by a skilled artisan. For example, divider shelf may be formed of a molded plastic material, glass, or may also comprise an insulating layer, similar to insulated shelf 40, or other material contemplated by a skilled artisan.

Refrigerator 10 may also include an internal door for accessing various portions of internal cold storage compartment 18, such as first compartment portion 20 or second compartment portion 22. In some cases, an internal door may be configured to access only first compartment portion 20 or only second compartment portion 22. In other cases, an internal door may be configured to access a portion of first compartment portion 20 and a portion of a second compartment portion 22. In at least one case, an internal door 48 may be configured to access an entire portion of first compartment portion 20 at once, or may be configured for selective access to only portions of first compartment portion 20.

Referring to the embodiment in FIGS. 3A and 3B, internal door 48 may include a main portion 50 and a secondary portion 60. In the illustrated embodiment, main portion 50 includes a front surface 51, rear surface 52, and a handle 53 for opening main portion 50 of internal door 48. As shown in the figures, main portion 50 may include a main portion frame 56 that extends down a side surface along a hinge axis 54 of internal door 48 and provides one or more anchor points for a top hinge 70 and a bottom hinge 72. By way of top hinge 70 and bottom hinge 72, internal door 48 may pivot about hinge axis 54 to provide access to first compartment portion 20. In some cases, main portion frame 56 may also extend around an entire edge of internal door 48, as shown in the illustrated embodiment.

Secondary portion 60 may also include a front surface 61, a rear surface 68, and a handle 63, or other implement for opening secondary portion 60 of internal door 48. As shown in the figures, secondary portion 60 may be disposed in the same plane as main portion 50 such that when secondary portion 60 is in a closed position, secondary portion 60 fits within main portion frame 56 such that an edge surface 66 of secondary portion 60 abuts an edge surface 57 of main portion 50, and forms a contiguous surface with main portion 50. Secondary portion 60 may also be configured to pivot about a hinge axis 62 into an open position. Hinge axis 62 may be set inward, and offset from, hinge axis 54 as shown in FIG. 3A. In such an embodiment, the edge surface 57 of main portion 50 may provide one or more hinge anchor locations, e.g., hinge portion 74, for secondary portion 60 (FIG. 3B).

Main portion 50 and secondary portion 60 may be configured to provide a temperature seal for one or more areas of first compartment portion 20. In other words, internal door 48 may be constructed to be an insulating structure, as would be contemplated by a skilled artisan. In at least one case, main portion 50 may include a gasket 58 on rear surface 52 and secondary portion 60 may include a gasket 64 on rear surface 68. Thus, when internal door 48 is in a closed position, gasket 58 may be configured to provide an air barrier for a upper portion or area 27 of first compartment portion 20. Similarly, when internal door 48 is in a closed positon, gasket 64 of secondary portion 60 may also be configured to provide an air barrier for a lower area 28 of first compartment portion 20.

It should be understood that the illustrated configuration of internal door 48 is only one of many embodiments contemplated by the present disclosure. For example, internal door 48 may include additional portions beyond a main portion 50 and a secondary portion 60. Further, the hinge axes for one or more portions of internal door 48 may extend in different directions. Additionally, one or more portions of internal door 48 may be any sort of enclosure contemplated by a skilled artisan, including but not limited to drawers and glass enclosures.

Refrigerator 10 may be configured such that a freezer portion is expanded or made smaller, and selective access is provided to the first compartment portion 20 via internal door 48. Referring to FIG. 4, when insulated shelf 40 is in a bottom position, e.g. in a receiving slot provided by rack 42, and divider shelf 44 is in a top position, e.g. in a receiving slot provided by rack 46, insulated shelf 40 may provide a temperature barrier against freezing air 32 such that both upper area 27 and lower area 28 of first compartment portion 20 comprises a freezer. In other words, when insulated shelf 40 and divider shelf 44 are configured as in the embodiment of FIG. 4, the freezer portion of refrigerator 10 has a height 76 and a refrigerator portion of refrigerator 10 has a height 77. In the embodiment of FIG. 4, insulated shelf 40 may provide a temperature barrier between freezing air 32, flowing into upper area 27 and lower area 28 of first compartment portion 20, and cold (not freezing) air 34 flowing into second compartment portion 22.

Figure 5:
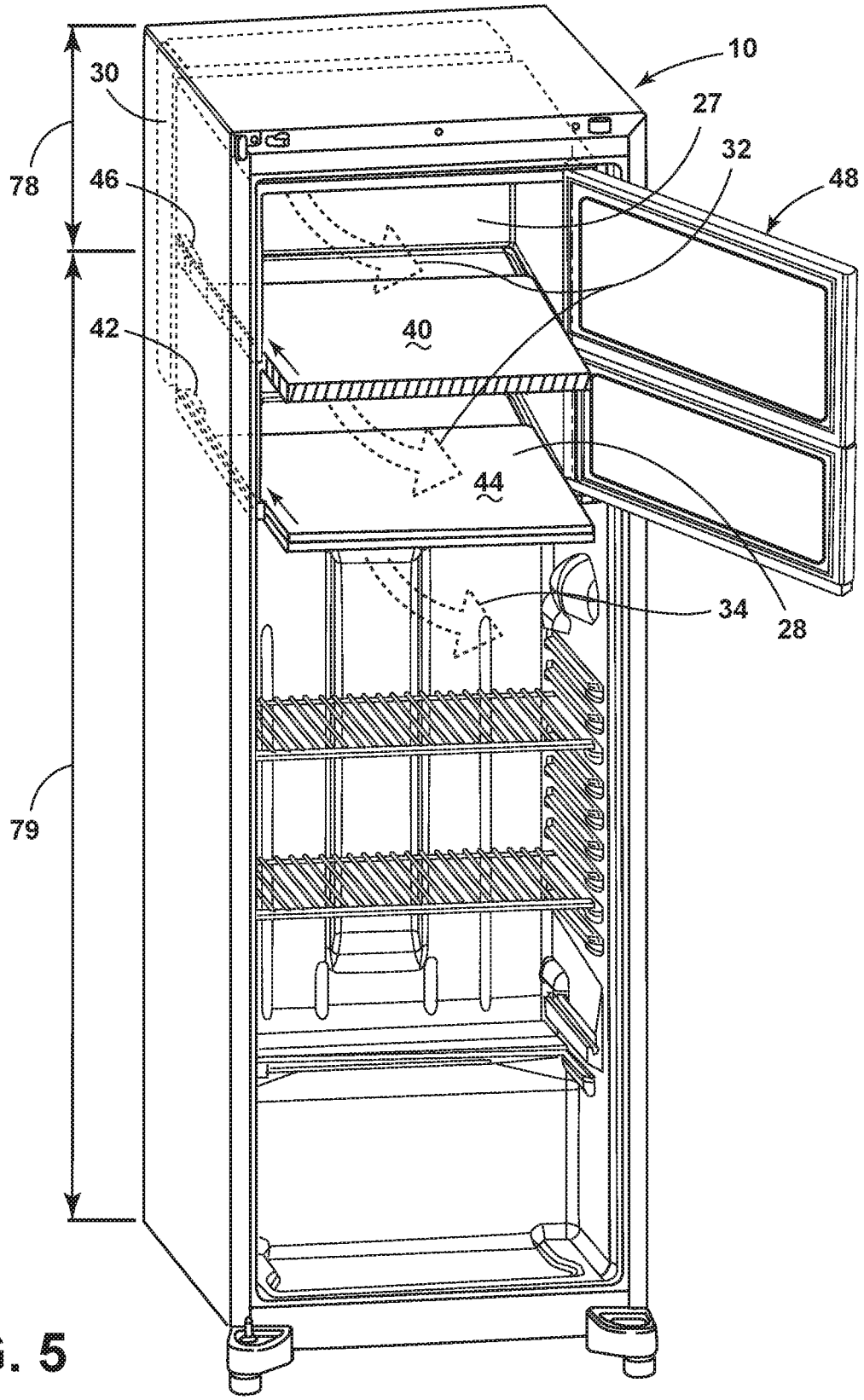

In the configuration of FIG. 5, insulated shelf 40 and divider shelf 44 have been removed and interchangeably received in the receiving slots provided by rack 46 and rack 42, respectively. Accordingly, when insulated shelf 40 is in a top position, e.g., in the receiving slot provided by rack 46, and divider shelf 44 is in a bottom position, e.g., in the receiving slot provided by rack 42, as shown in FIG. 5, the freezer portion of refrigerator 10 may be made smaller such that the lower area 28 becomes part of the refrigerator portion of refrigerator 10. In other words, when insulated shelf 40 and divider shelf 44 are configured as in the embodiment of FIG. 5, the freezer portion of refrigerator 10 has a height 78 and a refrigerator portion of refrigerator 10 has a height 79. In the embodiment of FIG. 5, insulated shelf 40 may provide a temperature barrier between freezing air 32, flowing into only upper area 27 of first compartment portion 20, and cold (not freezing) air 34 flowing into second compartment portion 22 and lower area 28.

According to some embodiments, internal door 48 may allow selective access to first compartment portion 20 to prevent leakage of freezing air 32 from a freezer portion of refrigerator 10. In particular, internal door 48 may provide selective access to both upper area 27 and lower area 28 of first compartment portion 20, or to only lower area 28 of first compartment portion 20.

According to one embodiment, referring back to FIG. 3B, both main portion 50 and secondary portion 60 of internal door 48 may be opened to provide access to both the upper area 27 and lower area 28 of first compartment portion 20. This configuration may be used when the entirety of first compartment portion 20, i.e. both upper area 27 and lower area 28, are configured as a freezer portion of refrigerator 10, as depicted in FIG. 4. However, when the freezer portion has been reduced, as shown in FIG. 5, such that only upper area 27 receives freezing air 32, secondary portion 60 may be opened separately to access lower area 28, preventing leakage of freezing air 32 from upper area 27. By leaving main portion 50 closed and only giving access via secondary portion 60, the upper area 27 of first compartment portion 20 stays sealed. Of course when the entirety of first compartment portion 20 comprises a freezer portion of refrigerator 10 (FIGS. 3A-4), secondary portion 60 also provides selective access to the lower area 28, or the specific configuration, a lower area of the freezer portion of refrigerator 10.

FIGS. 6-10 depict another embodiment of an internal door that may be used on a refrigerator 10. In the embodiment of FIGS. 6-10 refrigerator 10 may be configured with the same or similar components as described above. However, in an alternative illustrated embodiment, an internal door 80 rotates about an upper hinge axis 82 to gain access to first compartment portion 20.

Figure 8:
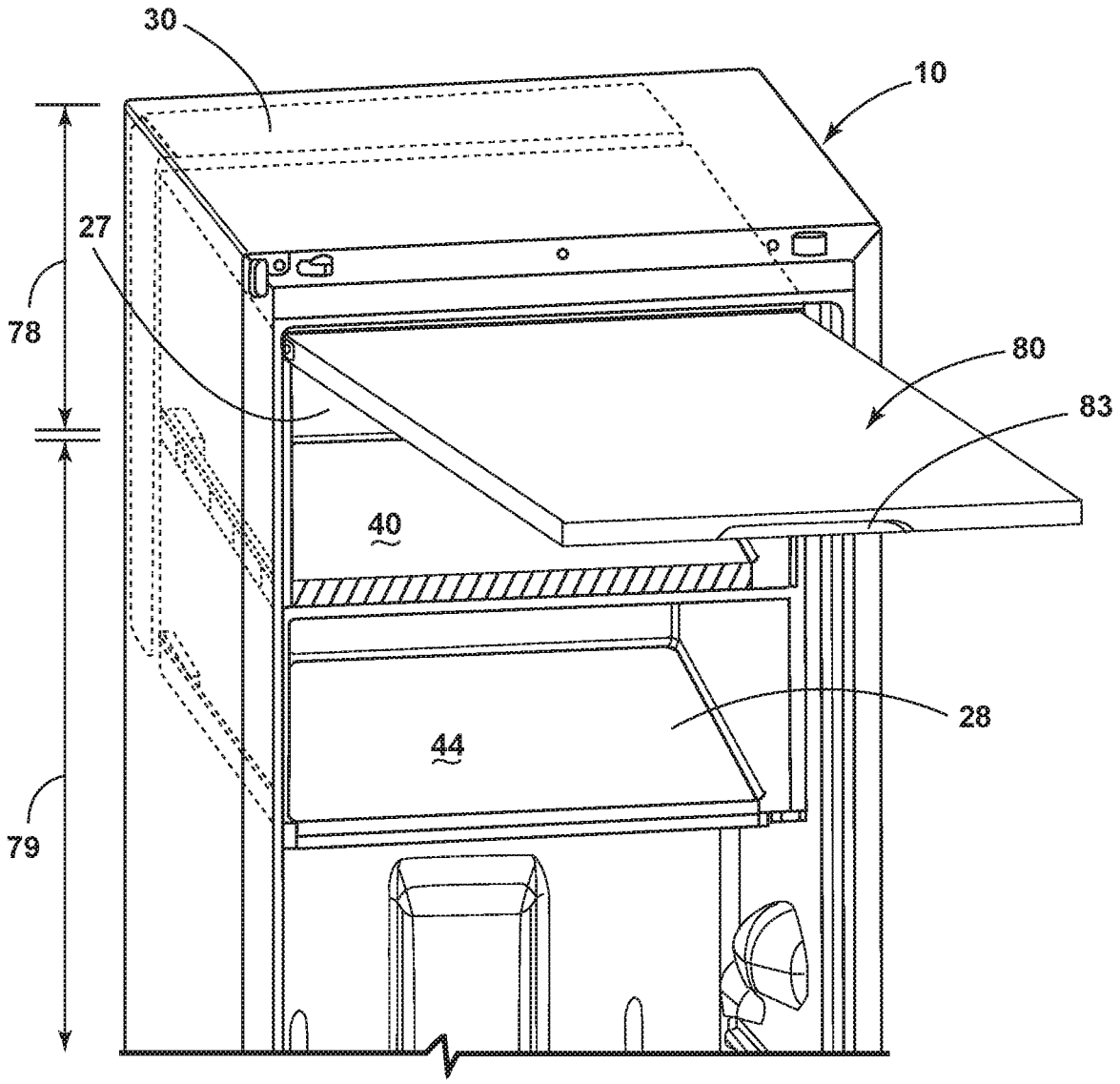
Figure 9:
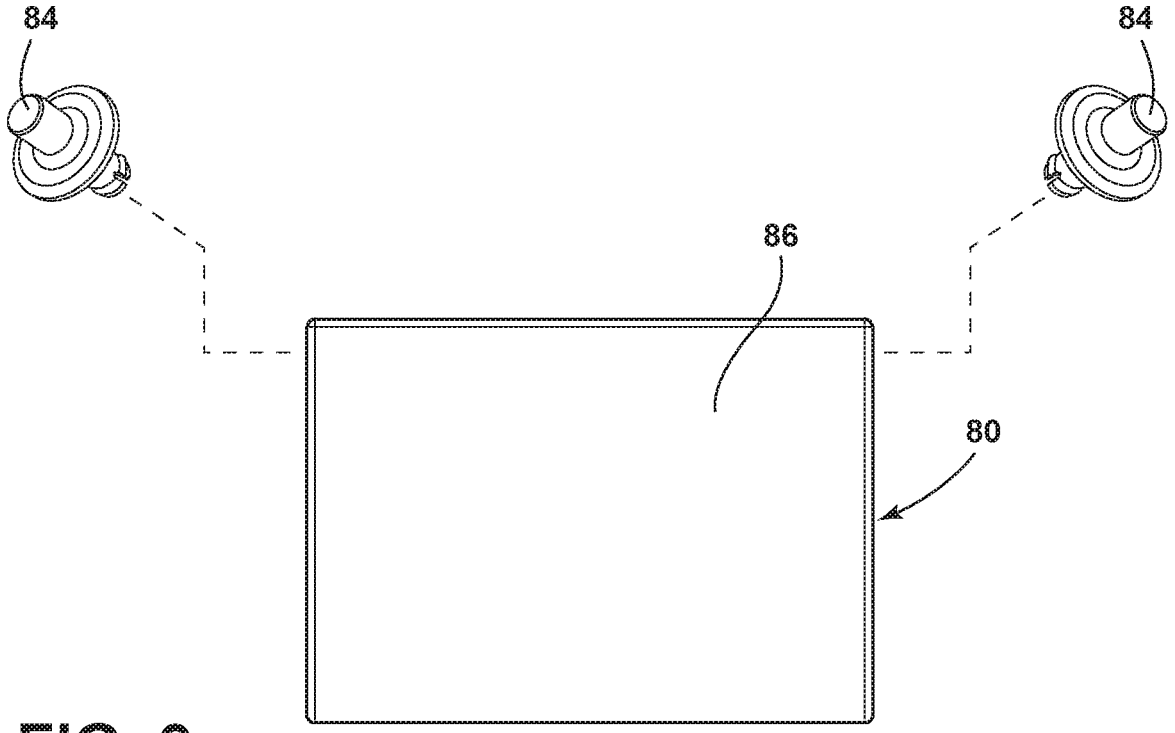
FIG. 9 is a front side view of an internal door for a refrigerator, according to an embodiment described herein.

According to at least one aspect described herein, internal door 80 includes a front surface 86, a rear surface 88 and a handle 83 for rotating internal door 80 into an open position. Referring to FIG. 8, hinge portions 84 may be coupled to the interior surface 24 of refrigerator 10 such that internal door 80 pivots up about hinge axis 82 for opening. In at least one case, hinge axis 82 is configured such that it runs in a direction that is perpendicular to hinge axis 16 of refrigerator 10. However, in other cases, the hinge axis may be aligned with the hinge axis 16 of refrigerator 10 such that internal door 80 pivots about a side hinge axis for opening.

Figure 6:
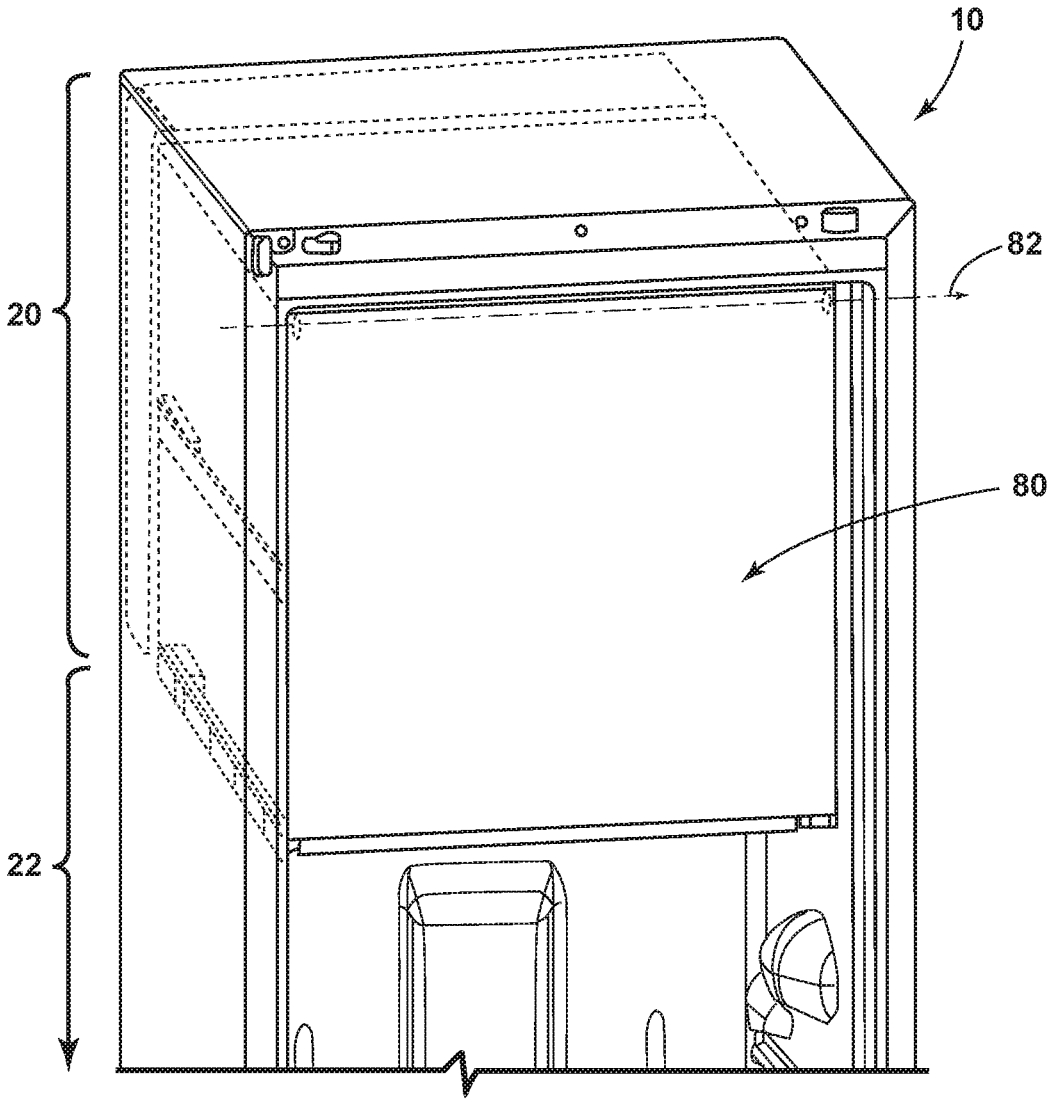
FIGS. 6-8 are partial top perspective views of the refrigerator with the front door removed, according to another embodiment described herein.
Figure 10:
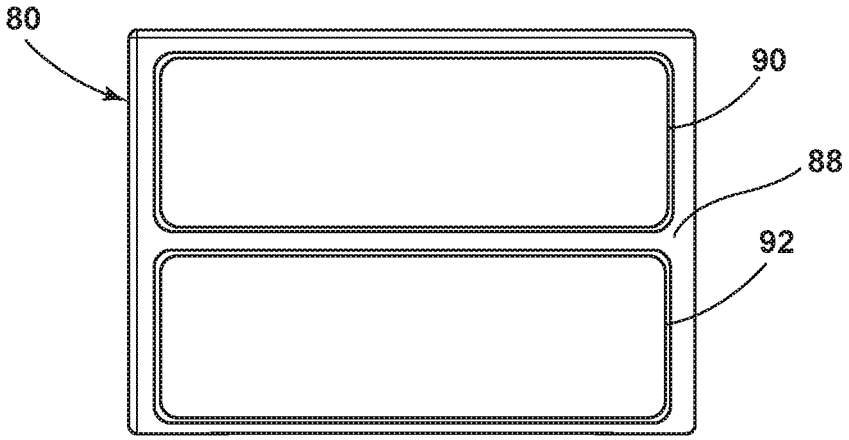
FIG. 10 is a back side view of an internal door for a refrigerator, according to an embodiment described herein.

Internal door 80 may also be configured to provide a temperature seal for one or more areas of first compartment portion 20. In other words, internal door 80 may be constructed to be an insulating structure, as would be contemplated by a skilled artisan. In at least one case, rear surface 88 of internal door 80 may further include a top gasket 90 and a bottom gasket 92 (FIG. 10). Thus, when internal door 80 is in a closed position, the top gasket 90 may provide an air barrier for a upper area 27 of first compartment portion 20. Similarly, when internal door 80 is in the closed positon, bottom gasket 92 may also be configured to provide an air barrier for a lower area 28 of first compartment portion 20. In other words, internal door 80 may cover the entire front surface of first compartment portion 20 such that gasket 90 and gasket 92 seal upper area 27 and lower area 28, respectively, of first compartment portion 20 when internal door 80 is in a closed position (FIG. 6). Alternatively, when internal door 80 is in an open position as shown in FIG. 7, the entirety of first compartment portion 20 is exposed for access.

Figure 7:
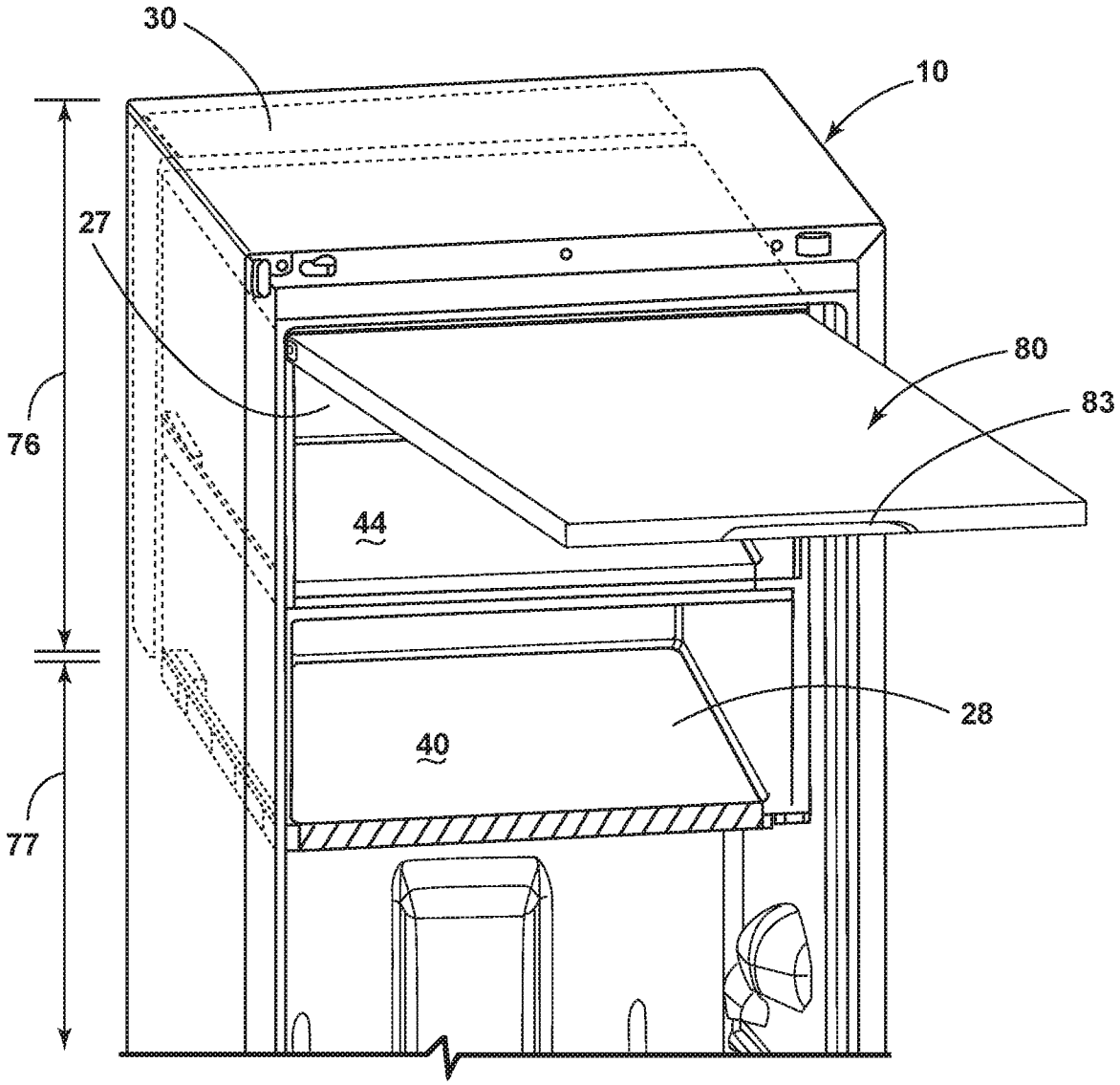

In the embodiment described with respect to FIGS. 6-10, insulated shelf 40 and divider shelf 44, shown in FIG. 7, may be configured as described above with respect to the embodiments of FIGS. 1-5. That is, when insulated shelf 40 is in a bottom position, or a lower receiving slot, as shown in FIG. 7, both upper area 27 and lower area 28 receive freezing air 32 and serve as a freezer portion for refrigerator 10, giving the freezer portion a height 76. However, the positions of insulated shelf 40 and divider shelf 44 are interchanged (FIG. 8), only upper area 27 receives freezing air 32 and serves as a freezer portion for refrigerator 10, giving the freezer portion the height 78. In the configuration of FIG. 8, because lower area 28 is below the insulated shelf 40, lower area 28 receives cold air 34 and serves as part of a refrigerator portion for refrigerator 10.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

The invention claimed is:

1. A door assembly for a refrigerator comprising:

a main door for accessing a first cold compartment positioned within a refrigerator cabinet, the main door configured to pivot about a main hinge axis between a closed position and an open position with respect to the first cold compartment, wherein the main door includes a first portion for sealing the first cold compartment and a frame portion extending from the first portion, the frame portion including a first edge surface; and a secondary door for accessing a second cold compartment positioned within the refrigerator cabinet, wherein the secondary door is coupled to the main door and is configured to pivot about a secondary hinge axis between a closed position and an open position with respect to the second cold compartment, wherein a second edge surface of the secondary door abuts the first edge surface of the frame portion when the secondary door is in the closed position, and further wherein the secondary door is configured to fit within the frame portion such that the secondary door is pivotable in conjunction with the main door into the open position with respect to the first and second cold compartments.

2. The door assembly of claim 1, wherein the secondary door is configured to pivot to the open position with respect to the second cold compartment when the main door is in the closed position with respect to the first cold compartment.

3. The door assembly of claim 1, wherein the main door and the secondary door are disposed in a common plane.

4. The door assembly of claim 1, wherein the secondary hinge axis is offset from the main hinge axis.

5. The door assembly of claim 1, wherein the first portion of the main door includes a first main door hinge portion coupled to the refrigerator and the frame portion of the main door includes a second main door hinge portion coupled to the refrigerator.

6. The door assembly of claim 5, wherein the secondary door comprises:

a first secondary door hinge portion coupled to the main door; and a second secondary door hinge portion coupled to the main door.

7. The door assembly of claim 6, wherein:

the first secondary door hinge portion is coupled to the first portion of the main door; and the second secondary door hinge portion is coupled to the frame portion of the main door.

8. A refrigerator comprising:

a cabinet defining a cold storage compartment, wherein a first portion of the cold storage compartment includes a freezer compartment and a second portion of the cold storage compartment includes a refrigerator compartment;

a door movably coupled to the cabinet for accessing the cold storage compartment, the door configured to pivot between a closed position and an open position with respect to the cold storage compartment;

a cooling component configured to generate cooled air and in fluid communication with both the freezer compartment and the refrigerator compartment;

an internal door for accessing the freezer compartment, the internal door having a main portion and a secondary portion, wherein the main portion is rotatable about a first hinge axis and the secondary portion is rotatable about a second hinge axis, the second hinge axis substantially parallel with the first hinge axis;

an insulated shelf configured to separate the freezer compartment and the refrigerator compartment and movable between a first position and a second position, wherein the insulated shelf is configured to be received by a first receiving slot defined by a first rack when the insulated shelf is in the first position, and wherein the insulated shelf is configured to be received by a second receiving slot defined by a second rack when the insulated shelf is in the second position;

wherein:

the main portion and the secondary portion of the internal door provide access to the freezer compartment when the insulated shelf is in the first position; and the main portion of the internal door provides access to the freezer compartment when the insulated shelf is in the second position; and a divider shelf configured to be selectively positioned within one of the first receiving slots and the second receiving slots, opposite the insulated shelf.

9. The refrigerator of claim 8 wherein:

the divider shelf is disposed within the freezer compartment in the second receiving slot; and the divider shelf is disposed within the refrigerator compartment in the first receiving slot.

10. The refrigerator of claim 8, wherein the secondary portion of the internal door is configured to open separately from the main portion of the internal door.

11. The refrigerator of claim 8, wherein the secondary portion of the internal door is at least partially disposed within a frame portion of the main portion.

12. The refrigerator of claim 8, wherein:

the insulated shelf and the divider shelf define a storage space within the cold storage compartment;

the storage space is part of the freezer compartment when the insulated shelf is in the first position; and the storage space is part of the refrigerator compartment when the insulated shelf is in the second position.

13. The refrigerator of claim 8, wherein the freezer compartment is disposed at an upper portion of the cold storage compartment.

14. A refrigerator comprising:

a cabinet defining a cold storage compartment, wherein a first portion of the cold storage compartment includes a freezer compartment and a second portion of the cold storage compartment includes a refrigerator compartment, and further wherein the refrigerator compartment includes shelves supported by shelf supports;

a door movably coupled to the cabinet for accessing the cold storage compartment, the door configured to pivot about a first hinge axis between a closed position and an open position with respect to the cold storage compartment;

a cooling component configured to generate cooled air and in fluid communication with both the freezer compartment and the refrigerator compartment;

an internal door for accessing the freezer compartment, wherein the internal door is configured to pivot about a second hinge axis that is perpendicular to the first hinge axis;

an insulated shelf that separates the freezer compartment from the refrigerator compartment, wherein the insulated shelf is movable between a first receiving slot and a second receiving slot to change a size of the freezer compartment, wherein the first receiving slot is defined by a first rack positioned on an interior surface of the cabinet, and further wherein the second receiving slot is defined by a second rack positioned on the interior surface of the cabinet, the first and second racks positioned above the shelf supports; and a divider shelf that is movable between the first receiving slot and the second receiving slot, wherein both the divider shelf and the insulated shelf are capable of being interchangeably received by the first receiving slot and the second receiving slot.

15. The refrigerator of claim 14, wherein:

the divider shelf is disposed within the freezer compartment in the second receiving slot; and the divider shelf is disposed within the refrigerator compartment in the first receiving slot.

16. The refrigerator of claim 14, wherein:

the insulated shelf and the divider shelf define a storage space within the storage compartment;

the storage space is part of the freezer compartment when the insulated shelf is in the first receiving slot; and the storage space is part of the refrigerator compartment when the insulated shelf is in the second receiving slot.

17. The refrigerator of claim 14, wherein the freezer compartment is disposed at an upper portion of the cold storage compartment.

* * * * *